US007997208B2

(12) United States Patent
Tabler

(10) Patent No.: US 7,997,208 B2
(45) Date of Patent: Aug. 16, 2011

(54) ANGLE LINE TRANSFER FOR OVERHEAD CONVEYORS

(75) Inventor: Charles P. Tabler, Cincinnati, OH (US)

(73) Assignee: OCS Intellitrak, Inc., Cincinnati, OH (US)

( * ) Notice: Subject to any disclaimer, the term of this patent is extended or adjusted under 35 U.S.C. 154(b) by 350 days.

(21) Appl. No.: 12/231,201

(22) Filed: Aug. 30, 2008

(65) Prior Publication Data

US 2010/0050899 A1 Mar. 4, 2010

(51) Int. Cl.
*B61B 12/02* (2006.01)

(52) U.S. Cl. ..... 104/96; 104/102; 104/130.06

(58) Field of Classification Search ..... 104/96, 104/102, 130.06
See application file for complete search history.

(56) References Cited

U.S. PATENT DOCUMENTS

| | | | | |
|---|---|---|---|---|
| 3,164,104 | A * | 1/1965 | Hunt | 104/166 |
| 3,850,250 | A | 11/1974 | Holden et al. | |
| 4,203,511 | A | 5/1980 | Uhing | |
| 4,265,178 | A | 5/1981 | Veith | |
| 4,358,999 | A | 11/1982 | Nagahori | |
| 4,367,683 | A | 1/1983 | Tokunaga | |
| 4,745,865 | A * | 5/1988 | Dehne | 104/172.3 |
| 4,756,401 | A * | 7/1988 | Kempton | 198/468.6 |
| 4,759,439 | A * | 7/1988 | Hartlepp | 198/833 |
| 4,909,373 | A * | 3/1990 | Geerts | 198/370.05 |
| 4,936,222 | A | 6/1990 | Murai | |
| 4,993,326 | A * | 2/1991 | Bergemann | 104/89 |
| 5,141,094 | A | 8/1992 | Speckhart et al. | |
| 5,143,201 | A | 9/1992 | Speckhart et al. | |
| 5,154,275 | A | 10/1992 | Speckhart et al. | |
| 5,335,781 | A * | 8/1994 | Miyagawa et al. | 198/834 |
| 5,806,655 | A * | 9/1998 | Tabler | 198/465.3 |
| 5,919,023 | A | 7/1999 | Owens, Jr. | |
| 6,032,785 | A * | 3/2000 | Beall, Jr. | 198/465.4 |
| 6,170,642 | B1 | 1/2001 | Galan et al. | |
| 6,179,701 | B1 * | 1/2001 | Tieleman | 452/179 |
| 6,267,060 | B1 * | 7/2001 | Owens, Jr. | 104/166 |
| 6,293,388 | B1 * | 9/2001 | Felter | 198/465.4 |
| 6,354,224 | B1 * | 3/2002 | Devnani et al. | 104/130.01 |
| 6,457,418 | B1 * | 10/2002 | Persson | 104/166 |
| 7,125,330 | B2 * | 10/2006 | Beeksma et al. | 452/178 |
| 7,178,661 | B2 * | 2/2007 | Tabler | 198/465.3 |
| 2007/0000756 | A1 * | 1/2007 | Tabler | 198/465.3 |
| 2008/0210523 | A1 * | 9/2008 | Owens et al. | 198/687.1 |
| 2008/0276419 | A1 * | 11/2008 | Tabler | 16/223 |
| 2009/0026042 | A1 * | 1/2009 | Tabler | 198/465.4 |
| 2009/0078149 | A1 * | 3/2009 | Tabler | 104/166 |
| 2009/0078535 | A1 * | 3/2009 | Tabler | 198/465.3 |
| 2010/0000440 | A1 * | 1/2010 | Meinzinger | 104/102 |
| 2010/0050899 | A1 * | 3/2010 | Tabler | 104/96 |

* cited by examiner

*Primary Examiner* — S. Joseph Morano
*Assistant Examiner* — Jason C Smith
(74) *Attorney, Agent, or Firm* — Chase Law Firm, L.C.

(57) ABSTRACT

A lateral transfer apparatus for an overhead conveyor comprises generally horizontally extending, side-by-side load tracks for receiving load-bearing trolleys for movement along a first track, and for movement along a second track. A transfer shuttle unit has a normal position aligned with the first track and provides a continuation thereof, and a transfer position aligned with the second track to provide a continuation of the second track. An actuator connected with the shuttle unit shifts it between the normal and transfer positions thereof at an acute angle to the tracks, thereby transferring trolleys to a position aligned with the receiving track for movement therealong.

6 Claims, 4 Drawing Sheets

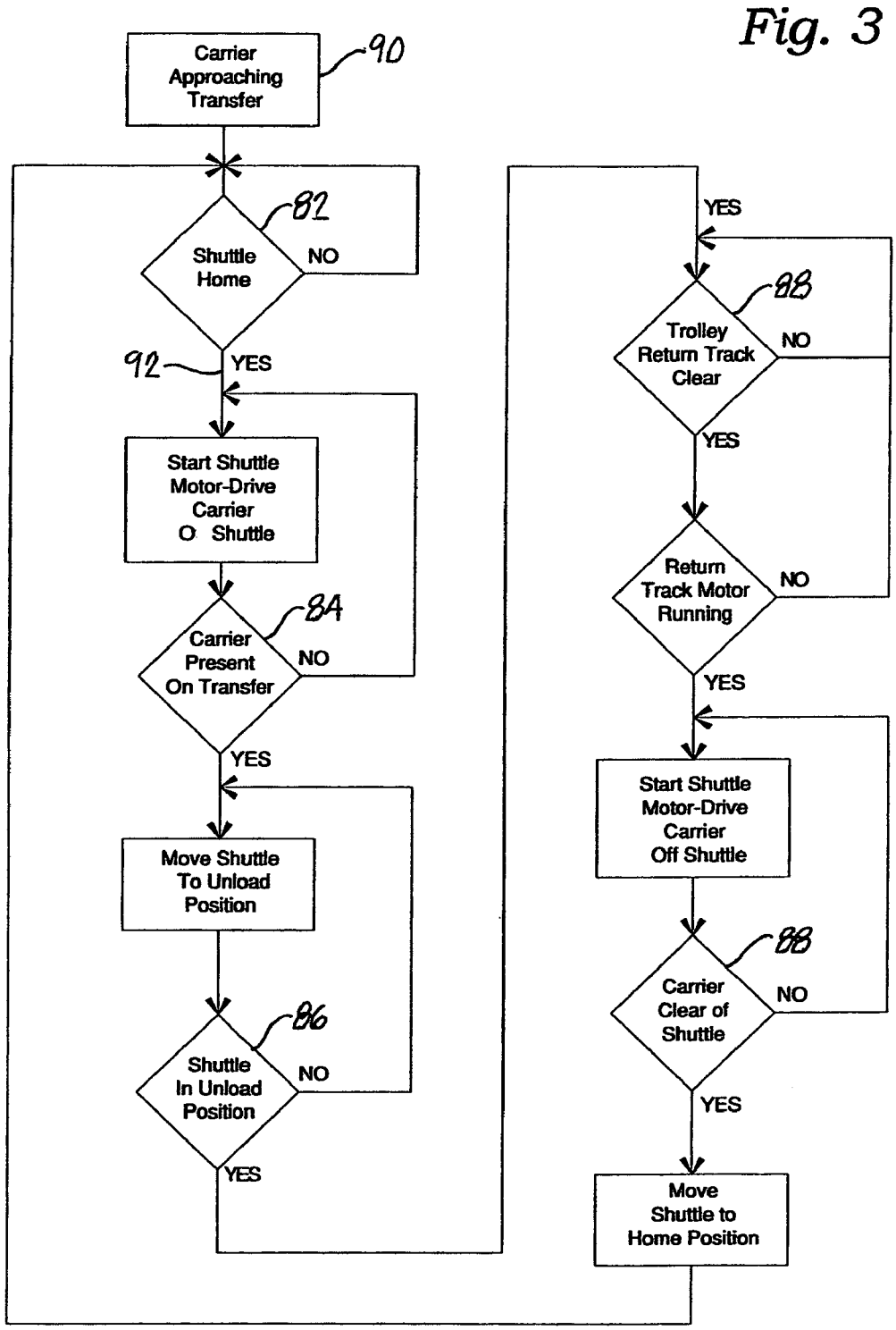
Fig. 3
Carrier Approaching Transfer
90
Shuttle Home
82
NO
92
YES
Start Shuttle Motor-Drive Carrier O Shuttle
Carrier Present On Transfer
84
NO
YES
Move Shuttle To Unload Position
Shuttle In Unload Position
86
NO
YES
YES
Trolley Return Track Clear
88
NO
YES
Return Track Motor Running
NO
YES
Start Shuttle Motor-Drive Carrier Off Shuttle
Carrier Clear of Shuttle
88
NO
YES
Move Shuttle to Home Position

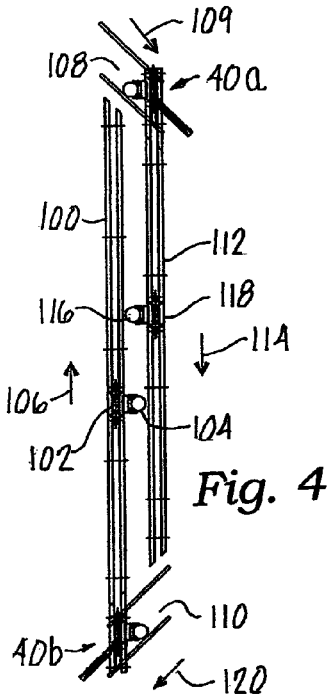
Fig. 4
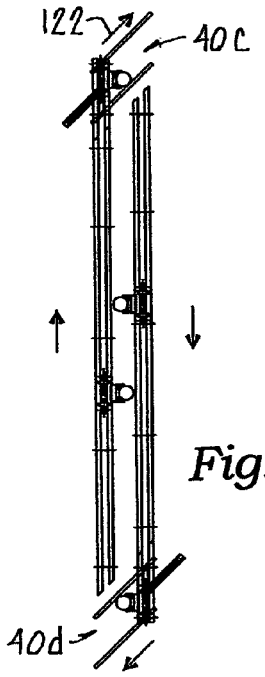
Fig. 5
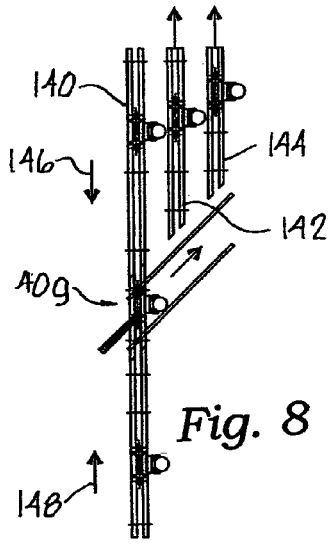
Fig. 8
Fig. 6
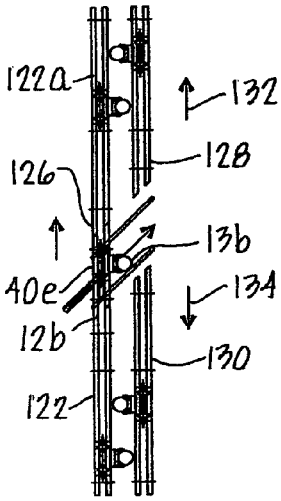
Fig. 7
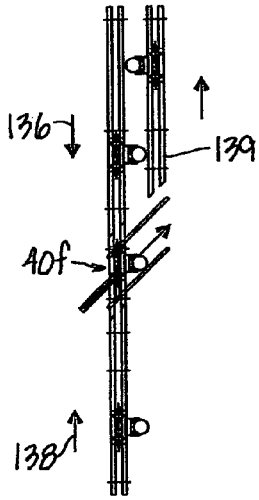
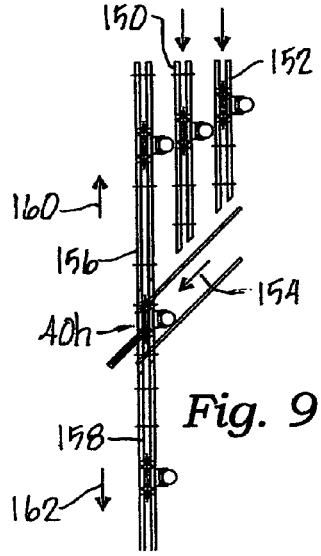
Fig. 9

ANGLE LINE TRANSFER FOR OVERHEAD CONVEYORS

This invention relates to overhead conveyor systems in which transfer of individual conveyors from one line to an adjacent line is accomplished by a direct line transfer.

BACKGROUND OF THE INVENTION

Overhead conveyors are utilized in various production, transportation, assembly and treatment environments to transport parts or products through various operational stages. One type of overhead conveyor employs a rotating, generally horizontal drive tube or shaft that supports trolleys from which the load is suspended. Drive wheels on the trolleys ride on the upper surface of the rotating drive tube, and each is mounted for rotation about a driven wheel axis that is non-parallel and non-perpendicular to the drive tube axis, preferably at an acute angle to the drive axis. To support the load, the trolleys are also provided with wheels that ride on rails that define the load track. In layouts where the trolleys repeatedly traverse side-by-side, supply and return sides of the conveyor (or a loop), a powered curve cannot be used unless the supply and return sides of the line are spaced apart a sufficient distance to accommodate two 90-degree turns to form a 180-degree turn at each end of the line. This typically consumes six or seven feet of floor space at each 180-degree turn, resulting in excessive dead space between the lines and restricting the design of an efficient conveyor layout.

SUMMARY OF THE INVENTION

In an embodiment of the present invention the aforementioned problem is addressed by providing a lateral transfer apparatus for the trolleys of an overhead conveyor. Closely spaced, side-by-side load tracks, which may define the supply side (infeed) and the return side (outfeed) of the conveyor, receive load-bearing trolleys for movement along a first track in one direction, and along a second, typically parallel track in the same or another direction. A transfer shuttle unit is provided which has a normal position aligned with one of the tracks and a transfer position aligned with the other track, and is actuated to shift the unit between a normal position and a transfer position at an acute angle to the supply track and the receiving track, thereby transferring trolleys on the supply track to a position aligned with the receiving track for movement along the receiving track.

In another aspect of the invention the shuttle unit includes a track section aligned with the supply track when the unit is in a normal position, and aligned with the receiving track when the unit is in a transfer position. A transfer zone is defined by guide structure spanning the first and second tracks and supporting the shuttle unit for movement between the normal and transfer positions.

In a further aspect of the present invention, each of the supply and receiving tracks has a pair of load rails presenting staggered ends at the transfer zone defining an acute angle of approximately 45 degrees with the direction of movement of the trolleys. The shuttle unit has a pair of transfer rails presenting staggered ends at the transfer zone aligned with one another at the acute angle to define a path of travel of the shuttle unit along this acute angle between normal and transfer positions. Accordingly, the track section of the shuttle unit substantially abuts the ends of the first track when the shuttle unit is in its normal position, and substantially abuts the ends of the second track when the shuttle track is in its transfer position, whereby load-bearing trolleys are transferred by the shuttle unit from a first side of a line to a second side of the line for travel in a desired direction along the second track. Thereafter, the shuttle unit returns to its normal position for the next transfer operation.

Other advantages of this invention will become apparent from the following description taken in connection with the accompanying drawings, wherein is set forth by way of illustration and example, embodiments of the present invention.

BRIEF DESCRIPTION OF THE DRAWINGS

FIG. 3 is a flow diagram showing the operation of a system controller.

FIG. 4 is a diagrammatic plan view of a particular track configuration showing the supply and return sides of a stretch of an overhead conveyor, and illustrates transfer units of the present invention at the respective ends thereof.

FIG. 5 is a plan view similar to FIG. 4 showing an alternative embodiment.

FIG. 6 is a diagrammatic plan view illustrating a transfer with a two-way outfeed.

FIG. 7 is a diagrammatic plan view illustrating a two-way infeed.

FIGS. 8 and 9 are diagrammatic plan views illustrating an infeed and an outfeed with multiple lane selection.

DETAILED DESCRIPTION

Figure 1:
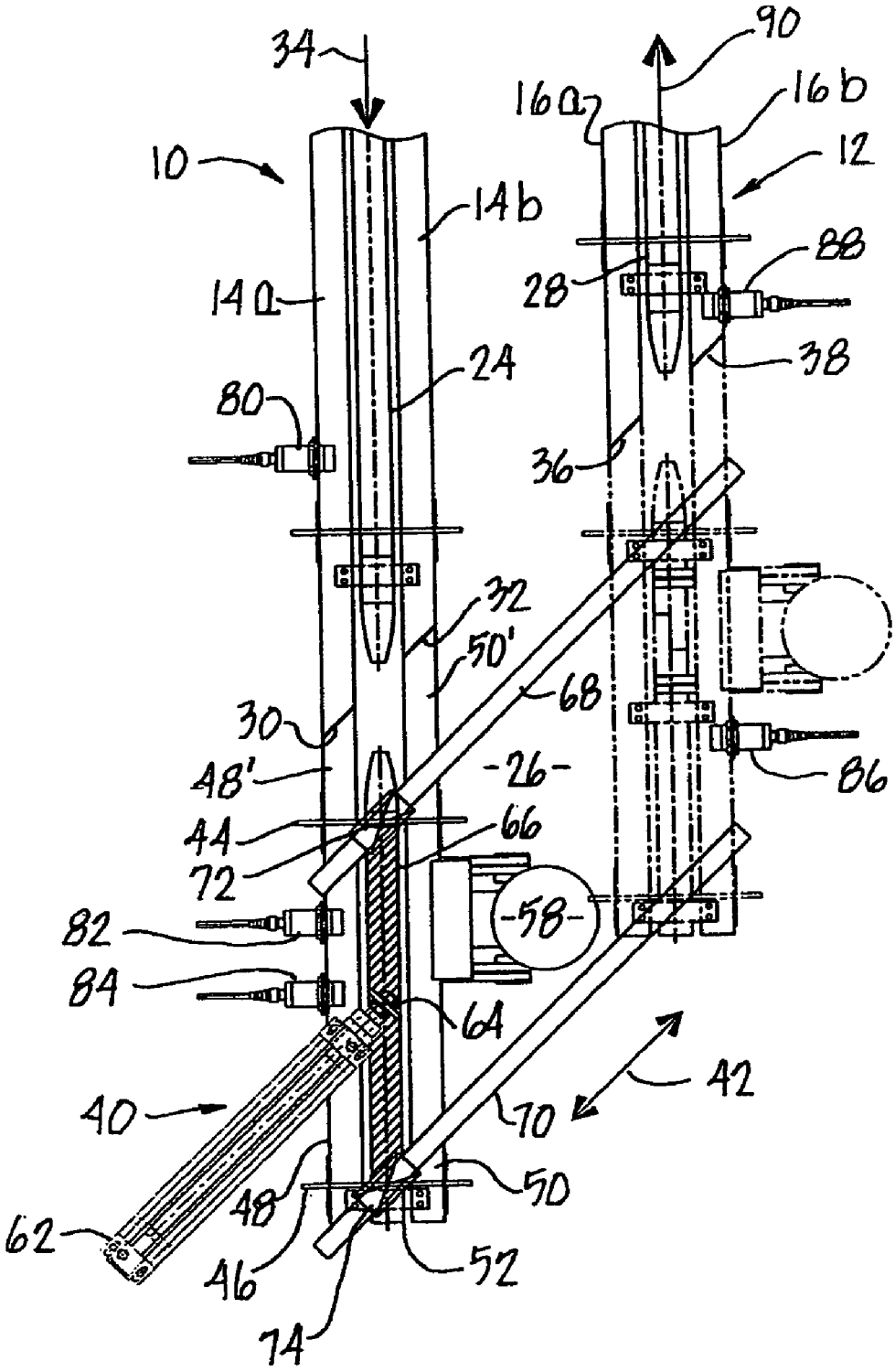
FIG. 1 is a fragmentary, plan view of an overhead conveyor showing the supply side and the return side of the line and a lateral transfer apparatus at one end of the conveyor, a transfer shuttle unit being shown in full lines aligned with the load rails on the supply side.
Figure 2:
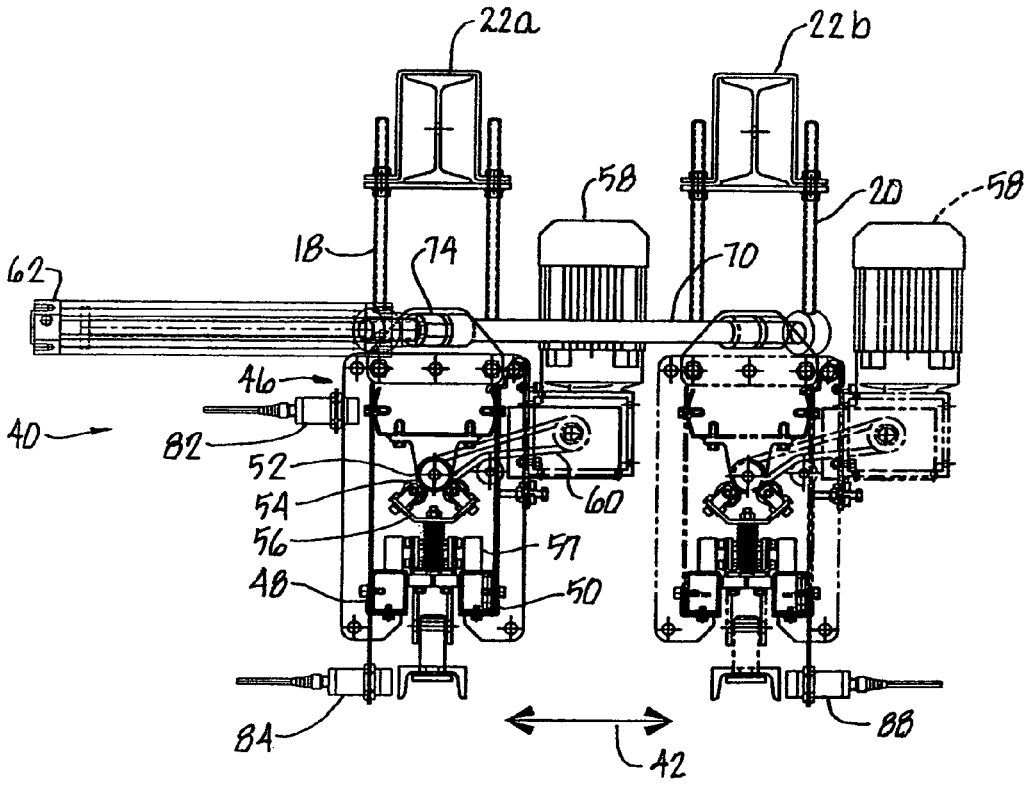
FIG. 2 is an end elevational view of the conveyor of FIG. 1 and additionally shows the overhead supports for the load rails.

Referring initially to FIGS. 1 and 2 of the drawings, one of the terminal ends of a pair of spaced, parallel tracks 10 and 12 of an overhead conveyor is shown. It may be appreciated that the tracks 10 and 12 extend to the opposite end of the conveyor (not illustrated) and thus the tracks define an overhead conveyor line that may be employed, for example, to transport parts or products through various operational stages. The track 10 has a pair of spaced, parallel load rails 14*a* and 14*b* and the track 12 is presented by a pair of spaced, parallel load rails 16*a* and 16*b*. Each pair of load rails 14*a*, 14*b* and 16*a*, 16*b* is supported in a conventional manner by a series of horizontally spaced pairs of hanger rods 18 and 20 spaced along the conveyor line (partially shown in FIG. 2) and secured at their respective upper ends to overhead I-beams 22*a* and 22*b*.

In the present invention the track 10 presents a supply track or infeed for the trolleys of the conveyor line, and the track 12 presents a return track or outfeed for the trolleys of the conveyor line. As is conventional in an overhead conveyor, a rotating drive tube 24 of the line is shown in broken lines in FIG. 1 and terminates at the end of the track 10 at a transfer zone 26 where, as will be set forth in detail hereinbelow, trolleys are sequentially transferred to the return track 12. Similarly, a rotating drive tube 28 for the return track 12 extends from the end of track 12 at the transfer zone 26.

In FIG. 1 it may be seen that the load rails 14*a* and 14*b* present staggered ends 30 and 32 respectively at the transfer zone 26 defining an acute angle with the direction of movement of trolleys along supply track 10, the staggered ends 30 and 32 defining a 45 degree angle with the line of the track 10 that defines the direction of movement of the trolleys (not shown) that are advanced by the rotating drive tube 24 in the direction of the infeed indicated by the arrow 34. Preferably, the ends 30 and 32 define a 45 degree angle (as shown in FIG. 1) with the direction of movement of the trolleys. Similarly, the return track 12 terminates at the transfer zone 26 at ends 36 and 38 in linear alignment with ends 30 and 32. The ends 36 and 38 define a 45 degree angle with respect to the return track 12 that provides the outfeed for the trolleys transferred by a shuttle 40 that, in its home position shown in full lines, receives individual trolleys delivered to the transfer zone 26 via supply track 10, and then shifts the trolley at a 45 degree angle into alignment with the return track 12. Arrow 42 illustrates the direction of movement of the shuttle 40 into alignment with return track 12 and return to the supply track 10.

More particularly, as seen in FIGS. 1 and 2, the shuttle 40 comprises a pair of spaced, inverted U-shaped hanger assemblies 44 and 46 supporting a pair of laterally spaced load rail sections 48 and 50 having forward end portions 48' and 50' terminating at a 45 degree angle and abutting supply track ends 30 and 32 in the receiving position thereof shown in FIG. 1. The outer surface of a drive tube or shaft 52 is engaged by four driven wheels 54 carried by a yoke plate member 56 supported on a trolley having load wheels 57 that run on load rails 48 and 50. As is conventional, driven wheels 54 have axes at an acute angle with respect to the axis of the drive tube 52 in order to propel a trolley thereon in an axial direction along drive tube 52 when the latter is driven by a motor 58 via a belt and pulley drive 60. Two of the wheels 54 are seen in FIG. 2 in engagement with drive tube 52. This drive arrangement is employed in the present invention to convey trolleys from the supply track 10 to the shuttle 40 for transfer to the return track 12. The 45 degree angle established by the ends 30 and 32 of the supply track 10 and the aligned ends 36 and 38 of the return track 12 provides a continuous track for the trolley load wheels as individual trolleys are delivered to the transfer zone 26 from track 10 and then shifted into alignment with return track 12 and advanced onto track 12 in the direction of arrow 90 without traversing a discontinuity in either direction when advancing over ends 30 and 32 onto rail end portions 48' and 50', and subsequently propelled from the shuttle 40 over ends 32 and 38 of the return track 12. A continuous load track is thus presented in both directions of transfer to and from the shuttle 40. Although an acute angle to each of the tracks 10 and 12 in the range of approximately 15 to 75 degrees could be employed, the 45-degree angle is preferred as laterally aligned load wheels 48 and 50 do not simultaneously roll over ends 30 and 32, or 36 and 38. For example, load wheel 50 clears end 32 before load wheel 48 reaches end 30.

Transfer is accomplished by a linear actuator or pneumatic cylinder 62 having a drive rod 64 shown retracted in FIG. 1. Rod 64 is connected at its outer end to a shuttle push bar 66 shown in cross section in FIG. 1. A pair of spaced, parallel, horizontally extending guide rods 68 and 70 are mounted on the top of respective hanger assemblies 44 and 46 and extend across the transfer zone 26. The guide rod 68 receives a bushing 72 slidable thereon and, similarly, the guide rod 70 receives a bushing 74 slidable thereon, both of the bushings 72 and 74 being secured to the respective ends of the push bar 66. When cylinder 40 is actuated, its piston rod 64, connected to push bar 66, shifts the shuttle to the right as indicated by arrow 42 to the position thereof shown in broken lines in FIG. 1 aligned with the return track 12. At this time as will be discussed in more detail below, the motor 58 is energized to drive the transferred trolley on to return track 12 to the receiving drive tube 28. After transfer, actuator 62 returns the transfer shuttle to its home position in alignment with the supply track or infeed 10. Although not shown, it will be appreciated that a support is provided for actuator 62 to maintain it in a horizontal position at the transfer angle.

A programmable logic controller (PLC) may be employed as a system controller for the shuttle unit in response to sensors associated with the supply and return tracks and the rail sections of the shuttle. Referring to FIGS. 1 and 2, five inductive proximity sensors are shown and comprise a shuttle present sensor 80 near the termination of supply track 10, a carrier present sensor 82 spaced above rail section 48, a shuttle present sensor 84 below rail section 48 of the shuttle 40, a shuttle present sensor 86 for sensing the shuttle 40 in the transferred position thereof aligned with the return track 12, and a carrier clear sensor 88 adjacent the end of the return track 12.

Referring to the flow diagram of FIG. 3 showing the operation of the system controller, a carrier is approaching the transfer (block 90) and is detected by the sensor 80 (FIG. 1). If sensor 82 indicates that the shuttle 40 is present at the home position, it produces a "Shuttle Home" output at 92 (YES) to initiate shuttle motor 58 to drive shaft 52 and propel trolleys on to load rail sections 48 and 50 of transfer zone 26. Shuttle present sensor 84 stops motor 58 when the shuttle is in its unload position, and initiates actuator 62 to transfer load rail sections 48 and 50 to an unload position in alignment with load rails 16*a* and 16*b* of the return track 12. Sensor 86 detects the shuttle in its unload position. If the return track 12 is clear (sensor 88) and the drive motor (not shown) for track 12 is in operation, motor 58 starts and drives shaft 52 to propel the trolleys onto return track 12 in the direction of arrow 90. Motor 58 is de-energized when the carrier clears sensor 88. Actuator 62 then returns the shuttle to its home position shown in full lines in FIGS. 1 and 2 where load rail sections 48 and 50 are in alignment with parallel rails 14*a* and 14*b* of the supply track 10. The shuttle 40 is thus returned to its home position for sequentially receiving additional trolleys from the supply or infeed track 10 and sequentially transferring them to the return or outfeed track 12.

Referring to FIGS. 4-9, six track configurations are shown diagrammatically and comprise examples of conveyor configurations that may be employed with the angular lateral transfer apparatus of the present invention. FIG. 4 illustrates a supply track 100 having a drive tube 102 partially shown) driven by a motor 104 for advancement of trollies in the direction of arrow 106. A transfer zone 108 at one end is provided with the shuttle 40*a* of the present invention for transfer of trolleys at a 45 degree angle to a return track 112 for movement in the opposite direction as shown by arrow 114. A drive tube 118 associated with return track 112 is diagrammatically illustrated and powered by a motor 116. The opposite end of the conveyor configuration has a transfer zone 110 where a shuttle 40*b* shifts the trolleys at a 45-degree angle in the direction of arrow 120 into alignment with supply track 100 for movement in the direction indicated by arrow 106. Accordingly, utilizing the 45-degree shuttles 40*a* and 40*b*, a continuous loop is provided utilizing parallel, closely spaced tracks 100 and 112.

FIG. 5 is an illustration similar to FIG. 4 except that a shuttle 40*c* at the end of the supply track shifts the trolleys at a 45-degree angle in the direction of arrow 122 at a 90-degree angle with respect to the directional arrow 109 in FIG. 4. Operation is otherwise the same as FIG. 4 with the return to the supply track being executed by shuttle 40*d*.

Referring to FIG. 6, in this illustration the transfer is effected at a mid-point in parallel tracks or at another location spaced from the ends thereof. Aligned tracks 122 and 122*a* terminate at 126 at a 45-degree angle and define a transfer zone where a shuttle 40*e* may deliver trolleys to either of the aligned tracks 128 and 130 for movement along outfeed track 128 in the direction illustrated by arrow 132, or movement along outfeed track 130 in the direction indicated by arrow 134. The direction of delivery is controlled by the shuttle drive motor 136.

The track configuration shown in FIG. 7 is similar to FIG. 6, but with track 130 omitted. FIG. 7 illustrates trolleys advancing along the supply track either from direction 136 or the opposite direction 138, and then transferring via shuttle 40*f* to an outfeed track 139.

FIG. 8 illustrates a multiple track outfeed. Trolleys advance along the infeed track 140 in either of two opposing directions 146 and 148 to a shuttle 40*g* for transfer to either outfeed track 142 or 144. In FIG. 9, an arrangement similar to FIG. 8 but reversed in flow is shown wherein infeed tracks 150 or 152 deliver trolleys to shuttle 40*h* for transfer as indicated by arrow 154 to either of the outfeed tracks 156 or 158 for movement in either direction 160 or in the opposite direction 162. From the foregoing it may be appreciated that various supply and return combinations can be employed with the lateral transfer apparatus of the present invention as dictated by the design of a conveyor layout.

It is to be understood that while certain forms of this invention have been illustrated and described, it is not limited thereto except insofar as such limitations are included in the following claims.

Having thus described the invention, what is claimed as new and desired to be secured by Letters Patent is as follows:

1. Angle line transfer apparatus for an overhead conveyor comprising:

first and second generally horizontally extending, side-by-side load tracks for receiving load-bearing trolleys for movement along said first track and for movement along said second track, a first transfer shuttle unit having a normal position aligned with said first track at a first transfer location and providing a continuation thereof, and a transfer position aligned with said second track at said first transfer location to provide a continuation of said second track, a second transfer shuttle unit having a normal position aligned with said second track at a second transfer location spaced along said conveyor from said first transfer shuttle unit and providing a continuation of said second track, and a transfer position aligned with said first track at said second transfer location to provide a continuation of said first track, a first actuator connected with said first shuttle unit for shifting the unit between said normal and transfer positions thereof at an acute angle to said first track, whereby to transfer trolleys on said first track to a position aligned with said second track for movement along said second track, and a second actuator connected with said second shuttle unit for shifting the second unit between said normal and transfer positions thereof at an acute angle to said second track, whereby to transfer trolleys on said second track to a position aligned with said first track for movement along said first track.

2. The apparatus as claimed in claim 1, wherein said acute angle is in the range of approximately 15 to 75 degrees.

3. The apparatus as claimed in claim 1, wherein said acute angle is approximately 45 degrees.

4. Angle line transfer apparatus for an overhead conveyor comprising:

first and second generally horizontally extending, side-by-side load tracks for receiving load-bearing trolleys for movement along said first track in an infeed direction and for movement along said second track in an outfeed direction, a first transfer shuttle unit having a normal position aligned with said first track at a first transfer location and providing a continuation thereof, and a transfer position aligned with said second track at said first transfer location to provide a continuation of said second track, a second transfer shuttle unit having a normal position aligned with said second track at a second transfer location spaced along said conveyor from said first transfer shuttle unit and providing a continuation of said second track, and a transfer position aligned with said first track at said second transfer location to provide a continuation of said first track, a first actuator connected with said first shuttle unit for shifting the unit between said normal and transfer positions thereof at an acute angle to said first track to transfer trolleys on said first track to a position aligned with said second track for movement along said second track, and a second actuator connected with said second shuttle unit for shifting the second unit between said normal and transfer positions thereof at an acute angle to said second track to transfer trolleys on said second track to a position aligned with said first track for movement along said first track.

5. The apparatus as claimed in claim 4, wherein said acute angle is in the range of approximately 15 to 75 degrees.

6. The apparatus as claimed in claim 4, wherein said acute angle is approximately 45 degrees.

* * * * *